US006391144B1

(12) United States Patent
Gilbert, Jr.

(10) Patent No.: US 6,391,144 B1
(45) Date of Patent: May 21, 2002

(54) WOOD WORKING JIG

(76) Inventor: Dana Gilbert, Jr., 109 Nickland Dr., Scott, LA (US) 70583

( * ) Notice: Subject to any disclaimer, the term of this patent is extended or adjusted under 35 U.S.C. 154(b) by 0 days.

(21) Appl. No.: 09/507,972

(22) Filed: Feb. 22, 2000

(51) Int. Cl.[7] ..... B25B 5/16

(52) U.S. Cl. ..... 156/304.1; 156/580; 269/41; 269/240

(58) Field of Search ..... 156/304.1, 305.5, 156/580; 269/37, 41, 88, 104, 136, 137, 138, 154, 240, 268

(56) References Cited

U.S. PATENT DOCUMENTS

| | | | | |
|---|---|---|---|---|
| 3,682,467 A | * | 8/1972 | Heinrich | 269/88 |
| 3,944,200 A | | 3/1976 | Huntley | |
| 4,061,321 A | | 12/1977 | Farr | |
| 4,122,739 A | | 10/1978 | Marlow | |
| 4,139,189 A | | 2/1979 | Wietrzvk | |
| 4,247,090 A | | 1/1981 | Hahn et al. | |
| 4,854,565 A | | 8/1989 | Ritsch | |
| 4,881,726 A | | 11/1989 | Jolkovski | |
| 5,423,626 A | * | 6/1995 | Peters | 403/362 |
| 5,730,433 A | * | 3/1998 | Veres | 269/41 |
| 5,737,990 A | | 4/1998 | Freeland et al. | |
| 5,768,966 A | | 6/1998 | Duginske | |
| 5,884,905 A | | 3/1999 | Keindl | |

* cited by examiner

*Primary Examiner*—Richard Crispino
*Assistant Examiner*—Cheryl N. Hawkins

(57) ABSTRACT

A jig for assembling a frame. The jig may be for woodworking and the frame may be for a picture. The jig comprises a top plate having a first and second opening. The top plate also contains an elongated slot. A bottom plate is laterally arranged below the top plate. The bottom plate contains a third and fourth opening. The bottom plate also contains an aligned elongated slot. A first guide bar and second guide bar are disposed through the openings in the plates, and fastener members, operatively associated with the first and second guide bar, is included for fastening the top plate and the bottom plate together. The jig may further comprise a guide member disposed between the top and bottom plate. The guide member has a first and second side that form a right angle so that the two inserted pieces of wood stock of the frame form a ninety degree corner. In one of the embodiments, a third and fourth guide bar are disposed through the top and bottom plates, with the third guide bar and the first guide bar being in a forty-five degree plane relative to the elongated slots. The fourth and second guide bars are disposed in a forty-five degree plane relative to the elongated slots. A method of joining pieces of stock with a jig into a frame is also disclosed.

12 Claims, 5 Drawing Sheets

WOOD WORKING JIG

BACKGROUND OF THE INVENTION

This invention relates to a novel jig. More particularly, but not by way of limitation, this invention relates to a woodworking jig for assembling a picture frame.

In the manufacturing and assembling of picture frames, the craftsman has to spend a significant amount of time insuring that all four angles of the picture frame are indeed ninety degree corners so that a rectangle is formed. The process of affirming the ninety degree corners is time consuming. Additionally, inherent problems with the formation of the corners sometimes results in a defective product such as the corners not being properly attached.

Prior art woodworking jigs have been designed. However, these prior art jigs suffer from several intrinsic defines. For instance, the prior art jigs are complicated and difficult to operate. Additionally, the prior jigs are expensive and costly to maintain.

Therefore, there is a need for a woodworking jig that is cost effective to manufacture. There is also a need for a woodworking jig that is easy to learn. Further, there is a need for a woodworking jig that is simple to operate. These and many other needs will be achieved by the novel invention herein disclosed.

SUMMARY OF THE INVENTION

A jig for assembling a frame is disclosed. In the preferred embodiment, the jig is for woodworking and the frame is a picture frame. The jig comprises a top plate having a first opening on a first end and a second opening on a second end of the top plate. The top plate also contains a first elongated slot. A bottom plate is laterally arranged below the top plate. The bottom plate contains a third opening aligned with the first opening and a fourth opening aligned with the second opening. The bottom plate also contains an aligned second elongated slot.

A first guide bar and second guide bar are disposed through the openings in the plates, and means, operatively associated with the first and second guide bar, is included for fastening the top plate and the bottom plate together. The fastening means may comprise thread means on the first and second guide bar; and, a first and second screw knob engaging the thread means.

The jig may further comprise a guide member disposed between the top and bottom plate. The guide member has a first and second side that form a right angle so that the two inserted pieces of wood stock form a ninety degree corner.

The jig may further comprise a third guide bar disposed through the top and bottom plates, with the third guide bar and the first guide bar being in a forty-five degree plane relative to the first and second elongated slot. A fourth guide bar may also be included that is also disposed through the top and bottom plates, with the fourth guide bar and the second guide bar being in a forty-five degree plane relative to the first and second elongated slot. Thread means may also be included on the third guide bar along with a third screw knob that threadedly engages the thread means on the third guide bar. Additionally, thread means may also be included on the fourth guide bar along with a fourth screw knob threadedly engaging the thread means on the fourth guide bar.

A method of joining pieces of stock into a frame is disclosed. The frame may be a picture frame. The method comprises applying glue to a first mitered edge of a first piece of stock and applying glue to a first mitered edge of a second piece of stock of the picture frame. Side one is inserted into a first opening in the jig. The jig consist of a top and bottom plate that contain an elongated slot. A first railing is disposed through the top plate and attaches to the bottom plate and is adapted to receive the first side of the piece of stock. The first railing forms a forty-five degree angle relative to the elongated slots. A second railing is disposed through the top plate and attaches the bottom plate and is adapted to receive the second side of the piece of stock. The second railing forms a forty-five degree angle relative to the elongated slots. Thread means are disposed on the first and second guide rails along with first and second screw knobs that engages the thread means.

The method further includes inserting a second piece of stock into a second opening in the jig against the railing at the forty-five degree angle and abutting the first side against the second side so that the first mitered edge and the second mitered edge form a ninety degree angle corner. The operator would fasten a first screw member and a second screw member to join the top plate with the bottom plate and clamp the pieces of stock within the jig. The operator would then set the first end of the jig on a guide fence of a table saw and cut a key slot into the joined ninety degree corner.

The method would further comprise providing a second jig and applying glue to a first mitered edge of the second piece of stock as well as applying glue to a first mitered edge of a third piece of stock. Then, the operator would insert the second piece of stock into a first opening in the second jig as well as inserting the third piece of stock into a second opening in the second jig against the railing at the forty-five degree angle.

The method includes abutting the mitered edges so that the first and the second edges form a ninety degree angle corner. The operator would then fasten a third screw member to join the top plate with the bottom plate as well as fasten a fourth screw member to join the top plate with the bottom plate. Next, the operator would set the first end of the second jig on the guide fence of the table saw and cut a key slot into the ninety degree corner.

The method further includes providing a third jig and basically repeating the steps. Thus, the method would include applying glue to a second mitered edge of the third piece of stock and applying glue to a first mitered edge of a fourth piece of stock. The operator inserts the third side into a first opening in the third jig and then inserts the fourth piece of stock into a second opening in the third wood working jig against the railing at the forty-five degree angle. The mitered edges are abutted so that the third side and the fourth side form a ninety degree angled corner.

Next, a fifth screw member and sixth screw member is fastened to join the top plate with the bottom plate. The operator would thereafter set the first end of the third jig on a guide fence of the table saw and cut a key slot into the joined angled corner.

The method would further comprise providing a fourth jig. Glue would be applied to a second mitered edge of the fourth piece of stock as well as applied to a second mitered edge of the first piece of stock. The first and fourth piece of stock are inserted into the openings in the fourth jig against the railing at the forty-five degree angle. The mitered edges are abutted against each other so that a ninety degree angled corner is created. The method further includes fastening a seventh screw member to join the top plate with the bottom plate and fastening an eighth screw member to join the top plate with the bottom plate. The first end of the fourth jig is set on the guide fence of the table saw and a key slot is cut into the corner.

The method may further comprise placing glue on a first, second, third and fourth key member and inserting the first, second, third, and fourth key members into the key slots. The operator could then remove the first, second, third, and fourth jigs and cut off excess material, such as wood, from the first, second, third and fourth key member.

An advantage of the present invention includes the ability for the operator to create 90 degree corners on a repetitive basis. Another advantage is that picture frames can be assembled rapidly with quality corners. Yet another advantage is that the novel woodworking jig is easy to operate and use. Still yet another advantage is that the novel woodworking jig is inexpensive. The keys and key slots form a loose tongued joint, and yet another advantage is that the jig aids in these cutting "loose-tongued" joints.

A feature of the present invention is the fastening system used in clamping the top and bottom plates together. Another feature is the ability to construct the plates out of plastic, wood, metal or other materials. Yet another feature is that the triangular guide member helps to square-off the mitered edges of the two pieces of stock in the jig. Still yet another feature is the 45 degree railing that allows each side of the frame to be properly inserted and oriented into the jig. Another feature is that the fasteners also act to orient and guide the sides in the proper forty-five degree phase.

DETAILED DESCRIPTION OF THE PREFERRED EMBODIMENTS

Figure 1A:
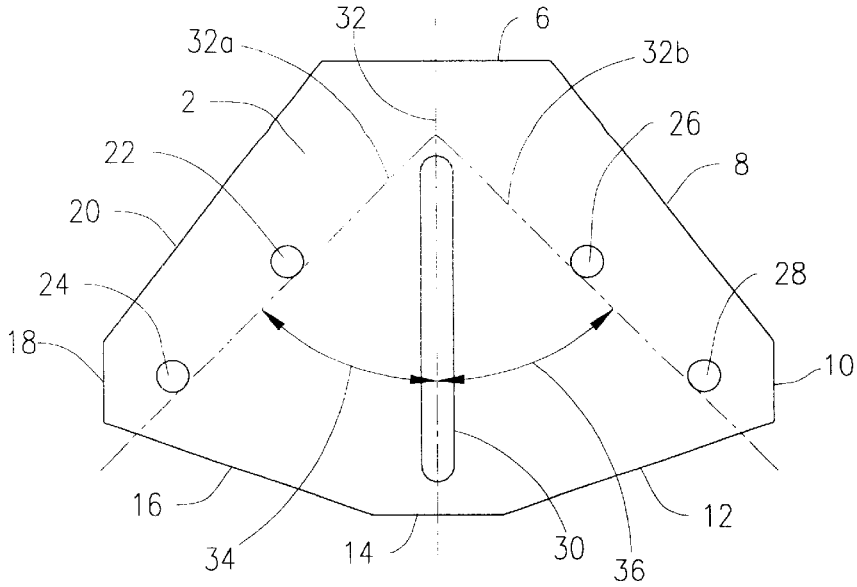
FIG. 1A is a top plan view of the top plate of the novel jig.

Referring now to FIG. 1A, a top plan view of the top plate 2 of the novel jig 4 will now be described. The top plate 2 includes the sides 6, 8, 10, 12, 14, 16, 18, 20. The top plate 2 also contains the two openings 22, 24 on one end of the plate 2, along with the two openings 26, 28 positioned on the other end of the plate 2. An elongated slot 30 is included in the center of the plate 2. A center line 32 is shown that runs through the slot 30.

The two openings 22, 24 will have guide post fitted therethrough and the openings 26, 28 will have guide post fitted therethrough as will be described later in the application. The two openings 22, 24 will form a 45 degree angle relative to the center line 32 and side line 32*a*, with the 45 degree angle being denoted by the numeral 34. The two openings 26, 28 will form a 45 degree angle relative to the center line 32 and side line 32*b*, with the 45 degree angle being denoted by the numeral 36.

Figure 1B:
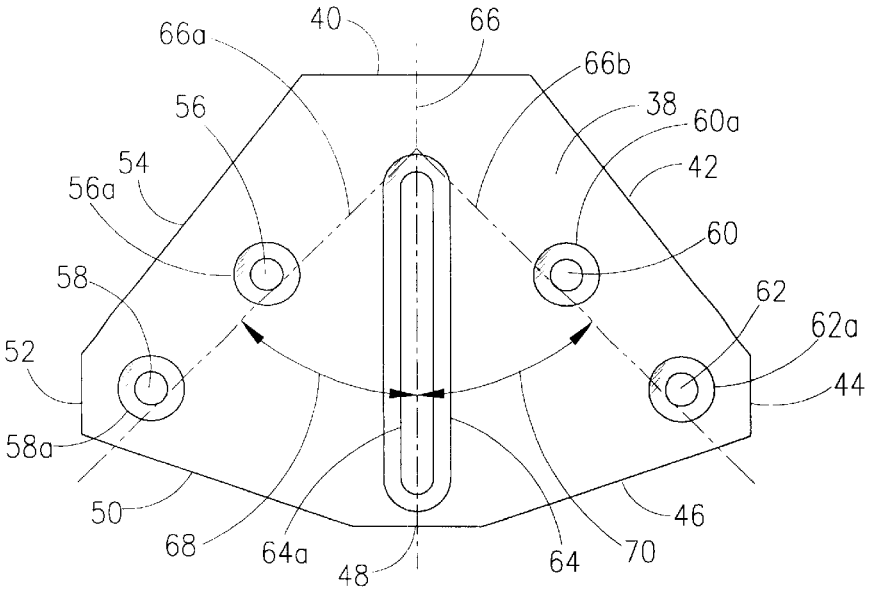
FIG. 1B is a top plan view of the bottom plate of the novel jig.

Referring now to FIG. 1B, a top plan view of the bottom plate 38 of the novel jig 4 will now be described. The top plate 2 includes the sides 40, 42, 44, 46, 48, 50, 52, 54. The bottom plate 38 also contains the two openings 56, 58 on one end of the plate 38, along with the two openings 60, 62 positioned on the other end of the plate 38. An elongated slot 64 along with an inner ledge 64*a*, is included in the center of the plate 38. A center line 66 is shown that runs through the slot 64.

The two openings 56, 58 will have guide post fitted therethrough and the openings 60, 62 will have guide post fitted therethrough as will be described later in the application. Opening 56 has a ledge 56*a* and opening 58 has ledge 58*a*; opening 60 has ledge 60*a* and opening 62 has ledge 62*a*. The two openings 56, 58 will form a 45 degree angle relative to the center line 66 and side line 66*a*, with the 45 degree angle being denoted by the numeral 68. The two openings 60, 62 will form a 45 degree angle relative to the center line 66 and side line 66*b*, with the 45 degree angle being denoted by the numeral 70.

Figure 1C:
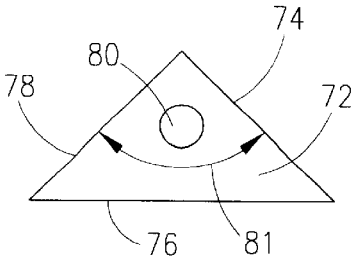
FIG. 1C is a top plan view of the triangular guide of the novel jig.

Referring now to FIG. 1C, a top plan view of the triangular guide 72 of the novel jig 2. The guide 72 may be an isosceles triangle having three sides 74, 76, 78 with a center opening 80, with all three sides 74, 76, 78 having equal lengths. The center opening 80 will cooperate with the slots 30, 64 as will be described later in the application. The ninety degree angle is denoted by the numeral 81.

Figure 2:
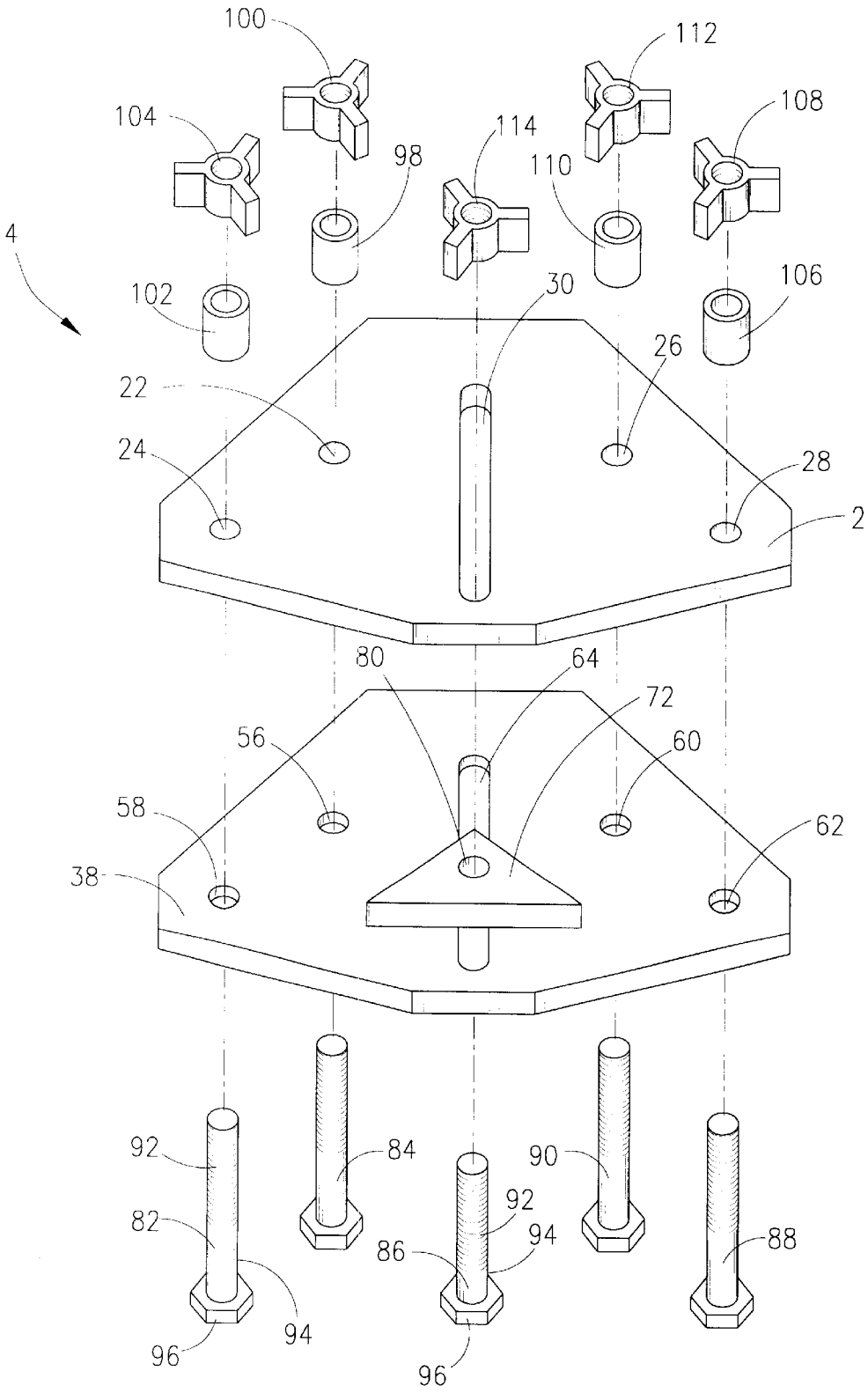
FIG. 2 is a three dimensional disassembled view of the novel jig.

With reference to FIG. 2, which is a three dimensional disassembled view of the novel jig 4, the bolts 82, 84, 86, 88, 90 are shown. It should be noted that like numbers appearing in the various figures refer to like components. All bolts have external threads 92 extending from a shaft 94 connected to a head 96. Thus, the bolt 84 fits through openings 56, 22 and is disposed through a washer 98 and will be threadedly engaged with a screw knob (also referred to as a nut) 100 having internal threads. The washers herein described will be nylon washers in the preferred embodiment. The washers, however, could by metal. Also, two washers in tandem could be used if desired. The bolt 82 fits through openings 58, 24 and is disposed through a washer 102 and will be threadedly engaged with a screw knob (nut) 104 having internal threads.

The bolt 88 fits through openings 62, 28 and is disposed through a washer 106 and will be threadedly engaged with a nut screw knob 108 having internal threads. The bolt 90 fits through openings 60, 26 and is disposed through a washer 110 and will be threadedly engaged with a nut screw knob 112 having internal threads. The bolt 86 is disposed through the slot 64, opening 80 (of the guide 72) and slot 30 and will be threadedly engaged with nut screw knob 114. The bolts placed within the jig may be referred to as guide bars and/or railings.

Figure 3:
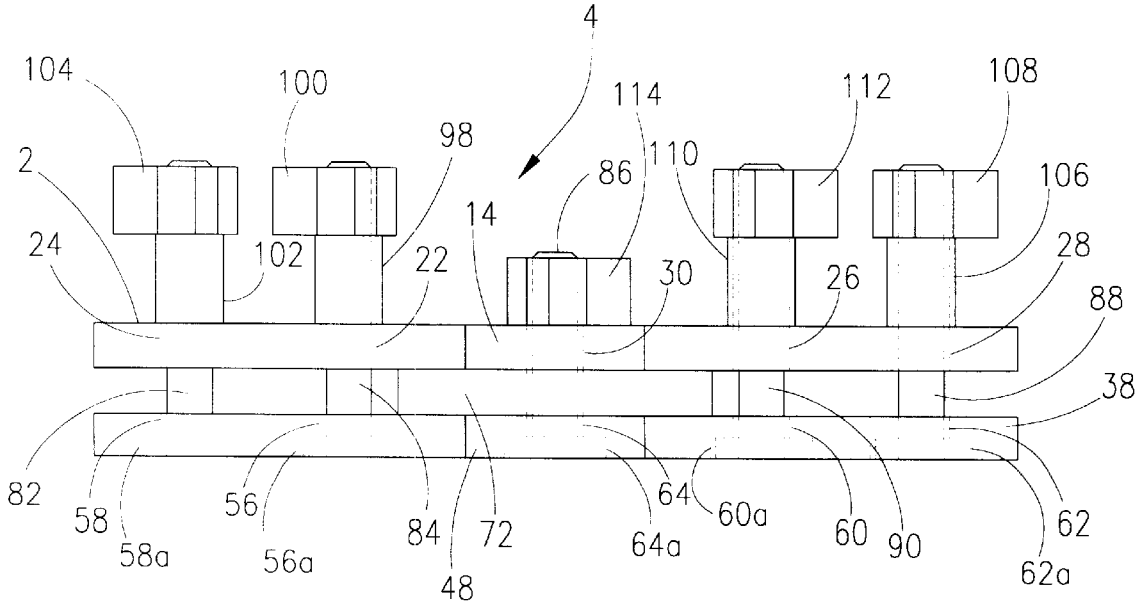
FIG. 3 is a front view of the novel jig.

A front view illustration of the jig 4 depicted in FIG. 3 will now be described. The bolt 82 is disposed through openings 22, 56, with the bolt 82 being coupled with screw 100; bolt 84 is disposed through openings 24, 58, with the bolt 84 being coupled with screw 104; bolt 86 is disposed through slots 30, 64, with the bolt 86 being coupled with screw 114; bolt 88 is disposed through openings 26, 60, with the bolt 88 being coupled with screw 112; and bolt 90 is disposed through openings 28, 62, with the bolt 82 being coupled with screw 108. The plate 2 is laterally arranged above plate 38. The guide 72 is disposed between top plate 2 and bottom plate 38. Note that the head 96 of the bolts will abut the ledges 56*a*, 58*a*, 60*a*, and 62*a*.

The pieces of stock frame will be inserted in the area between top plate 2 and bottom plate 38. The post 82, 84 serve as a rail to orient a first side and the post 88, 90 serve as a rail to orient a second side, as will be further explained later in the application. The act of advancing the screws will tighten the top plate about the two pieces of stock of the frame, as will be readily understood by those of ordinary skill in the art.

Figure 4:
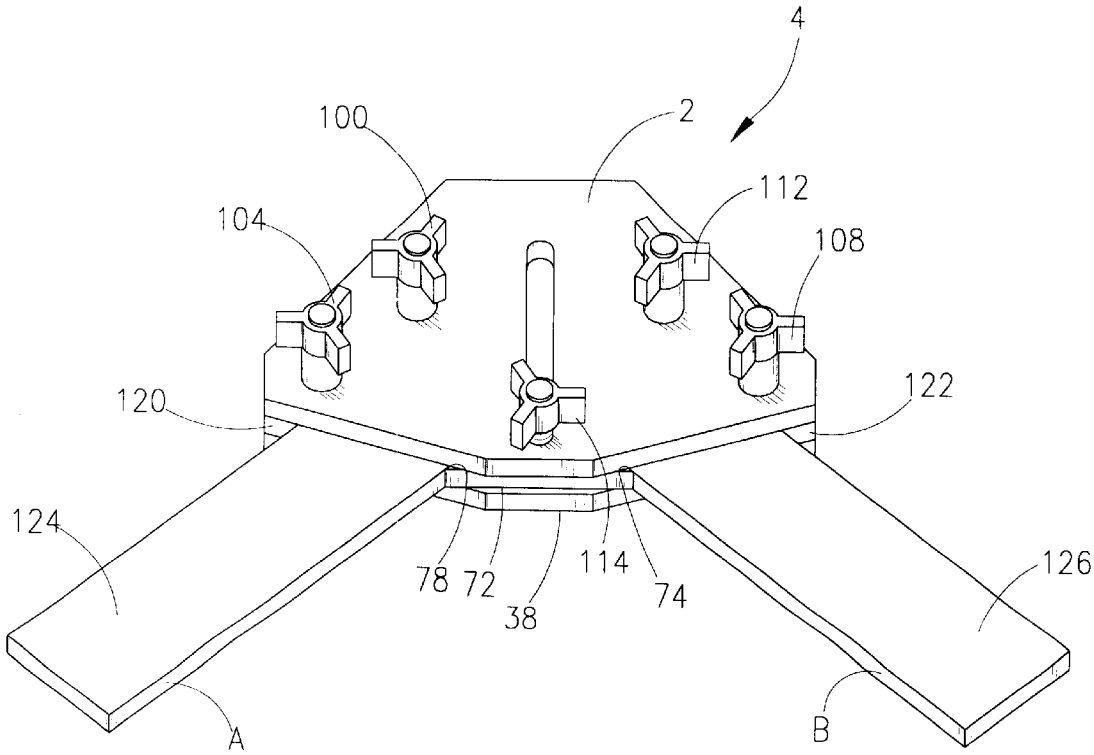
FIG. 4 is a perspective view of the assembled novel jig.

Referring now to FIG. 4, a perspective view of the assembled novel jig 4 will now be discussed. This view depicts an open area denoted by the numeral 120 as well as the open area denoted by the numeral 122. FIG. 4 illustrates two pieces of stock of the frame, namely side 124 and side 126. Thus, the plate 2 and plate 38 are unfastened. The operator would insert side 124 into the open area 120 and insert side 126 into the open area 122. The operator would then begin to tighten the screws 100, 104, 114, 112, 108 so that the plates 2 and 38 clamped down on the frame sides 124, 126.

Additionally, the frame side 124 is oriented into position by the rails 82, 84 at the 45 degree angle and the frame side 126 is oriented into position by the rails 88, 90 at the 45 degree angle. The guide 72 works to correctly align the sides 124, 126 by abutting side 78 of the guide 72 against edge A of stock 124 while side 74 is abutted against edge B of stock 126.

Figure 5:
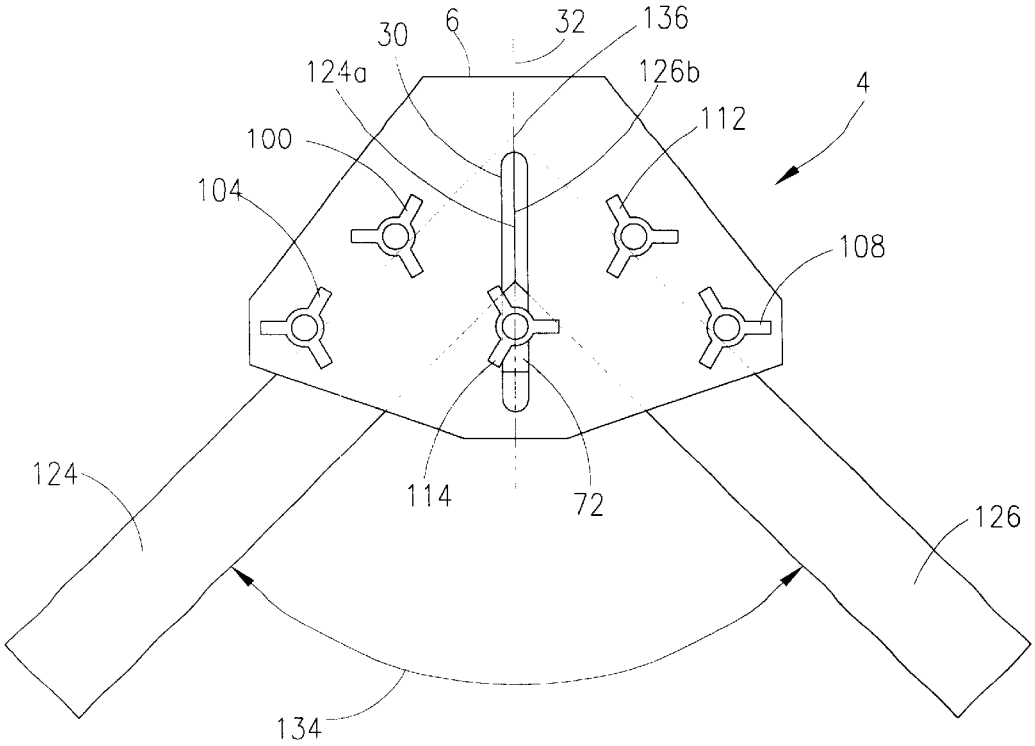
FIG. 5 is a top view of the assembled novel jig.

A top planar view of the jig 4 will now be described. As seen in FIG. 5, the side frame 124 and side frame 126 have been inserted and oriented into the openings 120 and 122. The mitered end 124*a* of the side frame 124 has been abutted with the mitered end 126*b* of the side frame 126. The ends 124*a*, 126*b* have been cut at a 45 degree angle in order to form a 90 degree corner as will be readily understood by those of ordinary skill in the art.

As depicted in FIG. 5, the angle that side frame 124 forms with side frame 126 is 90 degrees, denoted by the numeral 134. Note the position of the guide 72 relative to the side frame 124 and side frame 126 wherein the guide 72 acts to guide and orient the side frame 124 up against the railings 84, 82 as well as to guide and orient the side frame 126 up against the railings 88, 90. The elongated slot 30 allows the operator to slide the guide 72 into contact with sides 124, 126 and thereafter tighten the screw 114. Further, the other screws 100, 104, 108, 112 are tightened so that the sides 124, 126 are held in place. FIG. 5 further denotes the corner point 136 that is formed by the joining of sides 124, 126.

Figure 6:
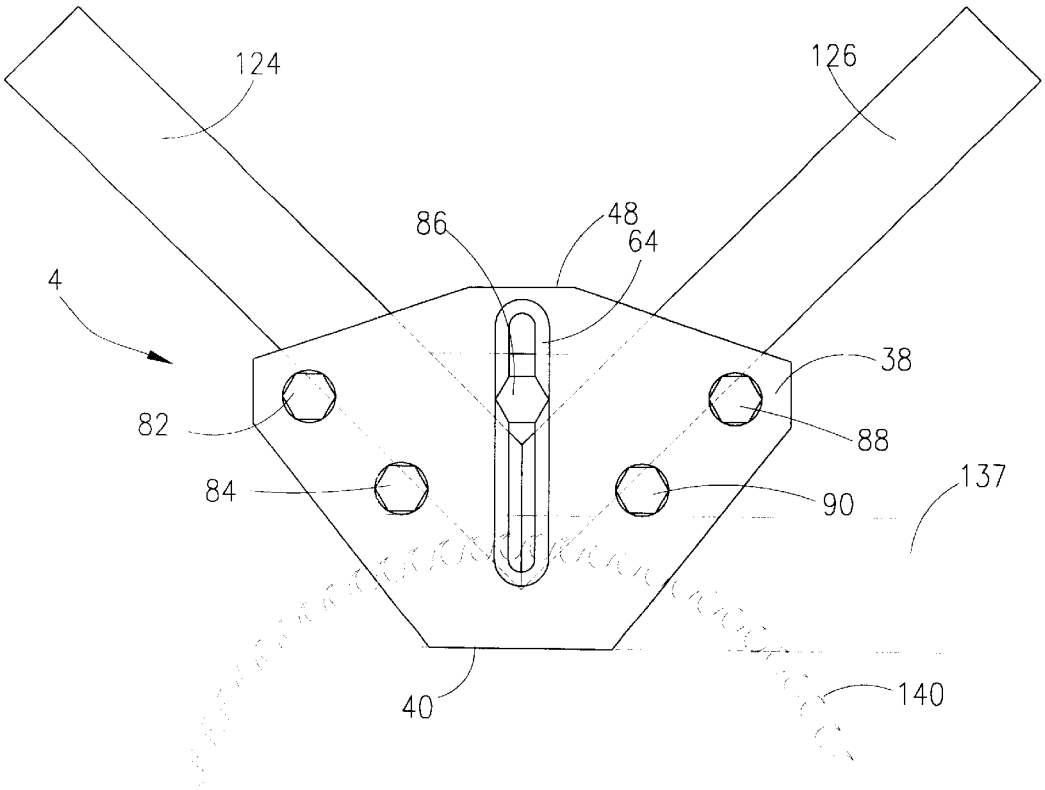
FIG. 6 is a schematic illustration of the novel jig having two sides of a frame being cut by a saw for forming a key slot.

FIG. 6 is a schematic illustration of the novel jig 4 with the sides 124, 126 of a frame being cut by a saw blade 140 for forming a key slot in the joined mitered edges. Thus, after inserting, orienting, and fastening the sides 124, 126, the operator may thereafter form a key slot. This is performed by placing the side 6 and 40 onto a table saw guide fence 137. A saw blade with guide fence is commercially available from many manufactures such as Delta Inc. under the name Table Saw. The saw blade 140 then cuts a slot onto the mitered edges.

Figure 7:
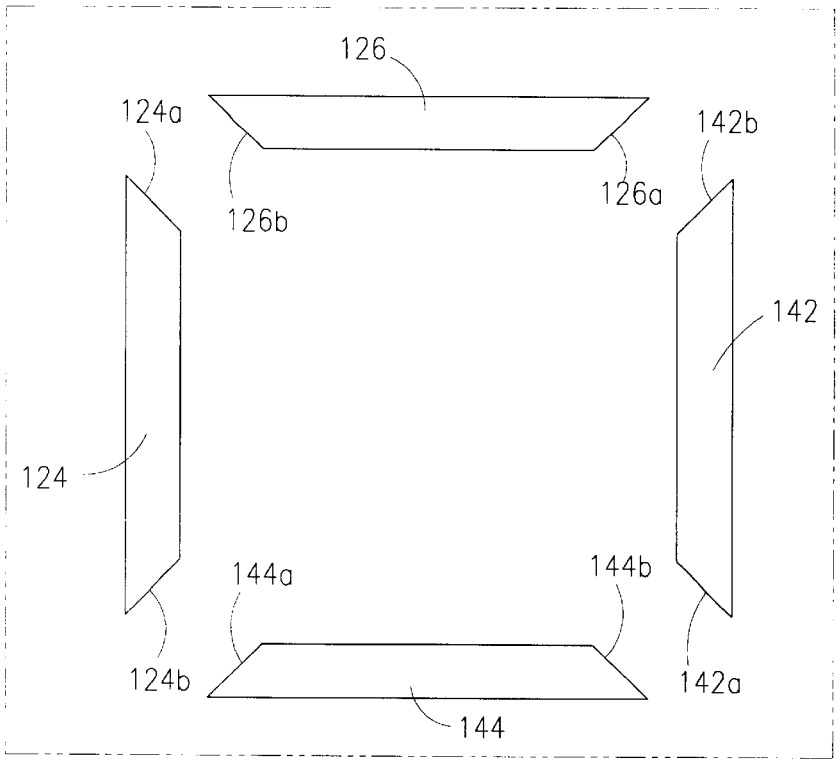
FIG. 7 depicts the four pieces of stock that form the frame.

FIG. 7 depicts the four pieces of stock that form the frame. In the preferred embodiment, the sides of the stock will be wood. Of course, other types of material are available such as plastic, metal, etc. Thus, FIG. 7 depicts the pieces of stock 124, 126 as well as pieces of stock 142, 144. As those of ordinary skill in the art will appreciate, each piece of stock has a mitered edge cut at a forty five (45) degree angle, with the stock 124 having mitered edges 124*a*, 124*b*; the stock 126 having mitered edges 126*a*, 126*b*; the stock 142 having mitered edges 142*a*, 142*b*; and, the stock 144 having mitered edges 144*a*, 144*b*.

Figure 8:
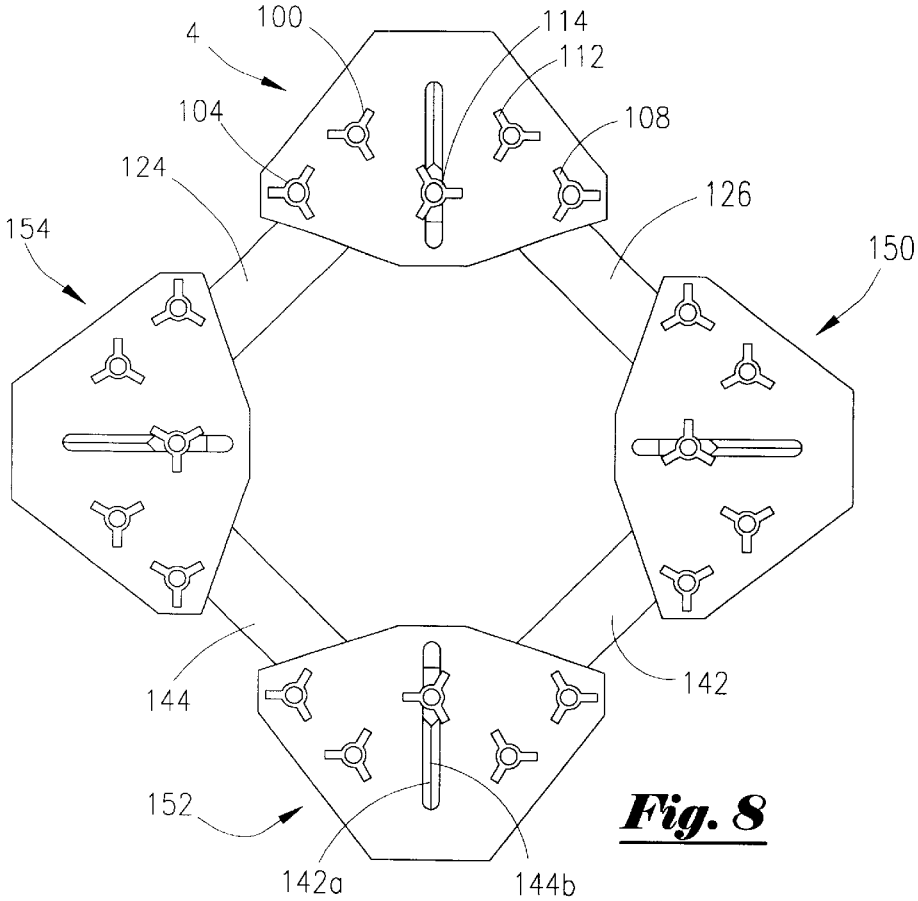
FIG. 8 is a schematic illustration of four novel jigs being used on all four corners of a frame.

Referring now to FIG. 8 is a schematic illustration of four novel jigs being used on all four corners of a frame. More particularly, FIG. 8 depicts jig 4, 150, 152, and 154. All four sides of a frame are shown, which include 142, 144, 124 and 126. Accordingly, the frame illustrated in FIG. 7 is a rectangular frame, as shown; the mitered edge 144*b* is abutted against mitered edge 142*a*. The other corners are similarly situated. Once all four sides have been placed in the respective jigs, the key slot can be cut (as shown in FIG. 6) to each individual mitered edge corner. Alternatively, it should be noted once two sides are placed within a single jig, the corner may be cut as shown in FIG. 6.

The method of assembling a frame, for instance a picture frame, would include the steps of applying glue to mitered edges of the stock (i.e. 130, 132). The stock is cut at a 45 degree angle. The stock (124, 126) is inserted at the 45 degree angle into the jig 4. The operator applies pressure to both sides of the jig 4 so that the stock is held firmly in place. The stock should be resting on the guide 82, 84, 88, 90. Then, the operator would tighten down the knobs on the guide screws 104, 100, 112, 108. Next, the squaring wedge 72 is slide onto the stock 124, 126 and the knob 114 is tightened.

The operator would then set the jig sides 6, 40 on the table saw guide fence 137 for cutting the key slot. In the embodiment shown, maximum blade height is two inches. Thus, the back side of the jig 4 is placed against the guide fence and the operator can proceed with the cut as seen in FIG. 6.

The above steps are repeated for the remaining sides of the frame. In order to make a key, the operator may use stock the same thickness as the depth of the slot made earlier, and make a desired cut to the desired width of the key. This piece of stock can be cut into four keys. The operator can apply glue to the slots and insert the keys. The excess glue can be wiped away and allowed to dry for the recommended curing time. The jigs 150, 152 and 154 can then be removed. Excess wood may be cut off with a hand saw or miter saw. The frame can be run through a table saw to finish the edges.

Changes and modifications in the specifically described embodiments can be carried out without departing from the scope of the invention which is intended to be limited only by the scope of the appended claims and any equivalents thereof.

I claim:

1. A woodworking jig for assembling a picture frame, the picture frame having four stock sides, the jog comprising:

a first plate having a first opening on a first end of said first plate and second opening there through formed on a second end of said first plate, and wherein said first plate contains a first elongated slot;

a second plate laterally arranged below said first plate, said second plate having a third opening aligned with said first opening and a fourth opening aligned with said second opening, and wherein said second plate contains a second elongated slot aligned with said first elongated slot;

a first guide bar disposed through said first opening and said third opening;

a second guide bar disposed through said second opening and said fourth opening;

means, operatively associated with said first guide bar and said second guide bar, for fastening said first plate and said second plate together;

a triangular guide member disposed between said first plate and said second plate, and wherein said triangular guide member has a first side and a second side that form a right angle, and wherein said triangular guide member has a guide member opening therein that is aligned with said first and second elongated slots.

2. The jig of claim 1 further comprising:

means, disposed through said guide member opening, for sliding said triangular guide member relative to said first and second elongated slots.

3. The jig of claim 2 wherein said means for fastening comprises:

thread means located on said first and second guide bars, a first and second nut engaging said thread means.

4. The jig of claim 3 further comprising:

a third guide bar disposed through said first and second plates, said third guide bar and said first guide bar being in a forty-five degree plane relative to said first and second elongated slots.

5. The jig of claim 4 further comprising:

a fourth guide bar disposed through said first and second plates, said fourth guide bar and said second guide bar being in a forty-five degree plane relative to said first and second elongated slots.

6. The jig of claim 5 further comprising:

thread means located on said third guide bar;

a third nut threadedly engaging said thread means on said third guide bar.

7. The jig of claim 6 further comprising:

thread means located on said fourth guide bar;

a fourth nut threadedly engaging said thread means on said fourth guide bar.

8. A woodworking jig for assembling a first piece of stock and a second piece of stock, the jig comprising:

a top plate having a first elongated slot;

a bottom plate connected to said top plate, and wherein said bottom plate contains a second elongated slot aligned with said first elongated slot;

a first guide bar disposed through said top plate and said bottom plate;

a second guide bar disposed through said top plate and said bottom plate;

thread means contained on said first and second guide bars;

a first and second nut engaging said thread means so that rotation of said first and second bars laterally joins said top plate and said bottom plate together;

an insert member disposed between said top plate and said bottom plate, and wherein said insert member has a first side and second side that form a right angle to guide said first piece of stock and said second piece of stock.

9. The jig of claim 8 further comprising:

a third guide bar disposed through said top and bottom plates, said third guide bar and said first guide bar being in a forty-five degree plane relative to said first and second elongated slots.

10. The jig of claim 9 further comprising:

a fourth guide bar disposed through said first and second plate, said fourth guide bar and said second guide bar being in a forty-five degree plane relative to said first and second elongated slot.

11. The jig of claim 10 further comprising:

thread means on said third guide bar;

a third nut threadedly engaging said thread means on said third guide bar.

12. The jig of claim 11 further comprising:

thread means on said fourth guide bar;

a fourth nut threadedly engaging said thread means on said fourth guide bar.

* * * * *